United States Patent [19]

Straaten et al.

[11] Patent Number: 4,596,173

[45] Date of Patent: Jun. 24, 1986

[54] BOBBIN SEPARATING UNIT

[75] Inventors: Paul Straaten, Straelen; Heinz-Lorenz Topütt, Mönchengladbach, both of Fed. Rep. of Germany

[73] Assignee: W. Schlafhorst & Co., Mönchengladbach, Fed. Rep. of Germany

[21] Appl. No.: 655,035

[22] Filed: Sep. 26, 1984

[30] Foreign Application Priority Data

Sep. 27, 1983 [DE] Fed. Rep. of Germany ..... 3334873

[51] Int. Cl.[4] ..... B26D 7/06; B65H 73/00

[52] U.S. Cl. ..... 83/112; 83/404; 83/370; 83/925 R; 83/909; 28/295; 28/292

[58] Field of Search ..... 83/112, 909, 925 R, 83/353, 404, 410, 370; 28/292, 293, 295, 297; 242/19, 35.5; 209/666

[56] References Cited

U.S. PATENT DOCUMENTS

| | | | |
|---|---|---|---|
| 2,179,804 | 11/1939 | Terrell | 28/295 |
| 3,699,833 | 10/1972 | Stoppard | 83/410 |
| 4,051,760 | 10/1977 | Glennan | 83/925 R X |
| 4,506,572 | 3/1985 | Küpper | 83/112 |

FOREIGN PATENT DOCUMENTS

| | | | |
|---|---|---|---|
| 1535196 | 9/1971 | Fed. Rep. of Germany | 28/292 |

*Primary Examiner*—Donald R. Schran

*Attorney, Agent, or Firm*—Herbert L. Lerner; Laurence A. Greenberg

[57] ABSTRACT

A bobbin separating unit, includes at least two first and second serially connected bobbin separating devices, the second bobbin separating device having a given upper level, the first bobbin separating device including a feeding device being controllable by the second bobbin separating device, the feeding device being movable from a bobbin receiving position to bobbin feeding positions disposed above the given upper level, and the feeding device including a feed location in the form of a vibratory conveyor.

11 Claims, 2 Drawing Figures

BOBBIN SEPARATING UNIT

Figure 1:
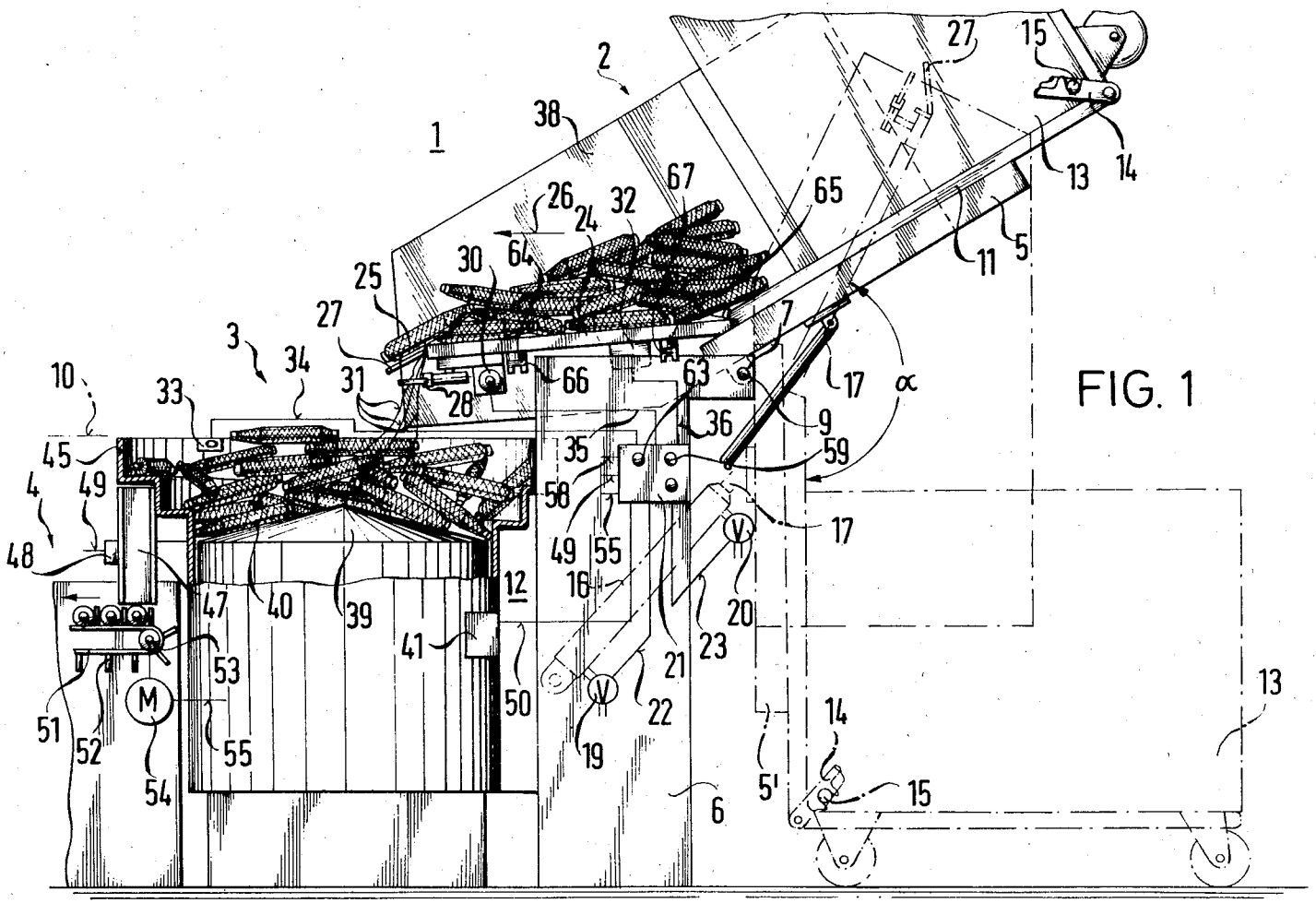

The invention relates to a bobbin separating unit including at least two serially connected bobbin separating devices, of which the first bobbin separating device is provided with a feeding device which is controllable by the second bobbin separating device and is movable from a bobbin receiving position to feeding positions situated above the upper level of the second bobbin separating device.

Bobbin separating units are utilized for feeding bobbins, one at a time and in quick succession, from a mass of randomly oriented bobbins to a subsequent apparatus, such as a bobbin readying station, a bobbin packing device, a tube stripping device, or the like.

Such bobbin units have the disadvantage that the transfer of the bobbins from the first to the second bobbin separating device is very irregular. Consequently, stoppages of machines due to overflowing or irregular working of the bobbin separating unit are bound to occur.

It is accordingly an object of the invention to provide a bobbin separating unit which overcomes the hereinafore-mentioned disadvantages of the heretofore-known devices of this general type, and to make sure that the separation of the bobbins is carried out quickly, gently and with a minimum space requirement and technical effort.

With the foregoing and other objects in view there is provided, in accordance with the invention, a bobbin separating unit, comprising at least two first and second serially connected bobbin separating devices, the second bobbin separating device having a given upper level, the first bobbin separating device including a feeding or charging device being controllable by the second bobbin separating device, the feeding device being movable from a bobbin receiving position to bobbin feeding positions disposed above the given upper level, and the feeding device including a feed table or location in the form of a vibrating conveyor.

In accordance with another feature of the invention, bobbins are transferred from the first to the second bobbin separating devices at a given transfer location, and including a yarn cutting device at the transfer location for cutting off trailing yarn ends.

In accordance with a further feature of the invention, the yarn cutting device includes at least one travelling cutter.

The advantages which can be obtained from the invention are particularly that a well dosed or metered retransmission of the bobbins can be achieved without causing disadvantages in the loading capacity of the bobbin separation device. This ensures an efficient and rapid operation of the whole bobbin separating unit and in particular, of the subsequent bobbin separating devices.

Any faults in the bobbin separating system caused by trailing yarn ends and entangled yarn ends are avoided by the proposed yarn cutting device. At the point of transfer, no yarn connection remains between the bobbin separating devices.

In accordance with an added feature of the invention, there is provided a comb disposed at a downstream end of the feed location, as seen in travel direction of the bobbins, the yarn cutting device being disposed below the comb in the feeding positions of the feeding device. The comb has its teeth pointed in the direction in which the bobbins are moved or in the direction in which they are fed.

The comb guards the bobbins against making contact with the cutting device for the trailing yarn ends, or with the travelling cutter of the cutting device. The individual trailing ends are caught between the comb teeth, thus preventing the trailing ends from gathering together into larger bundles of yarn, which make the cutting more difficult.

In accordance with an additional feature of the invention, there is provided a vibration generator for vibrating the vibratory conveyor. This can be a vibrator, a vibrating motor, or some other device generating an imbalance.

In accordance with again another feature of the invention, the vibration generator is controllable by the second bobbin separating device. If, for instance, the second bobbin separating device signals a shortage of bobbins, the vibration generator can be put into operation. In addition, a tipping mechanism can be switched on, which in turn changes the feeding position, or the angle of inclination, of the feed location or table. If the second bobbin separating device thereupon signals an excess of bobbins, the devices can be switched off until the next shortage of bobbins is signalled.

After an extreme maximum feeding position has been reached and a bobbin shortage has been signalled, only the vibration generator is switched on, and at the same time, the shortage of bobbins can be signalled to the filling device, since it is now time to provide for a fresh supply of bobbins.

In accordance with again a further feature of the invention, there are provided vibration absorbing devices connecting the feed location to the feeding device.

In accordance with again an added feature of the invention, the feeding device includes protective walls, and vibration absorbing devices connecting the protective walls to the feed location. These may be rubber buffers which keep the vibrating masses small and do not transmit any major vibrations to the feeding devices or to the bobbin conveying mass.

In accordance with a concomitant feature of the invention, the feed location is swingable upward into a level position, the feeding device is pivotally mounted, the feed location is disposed at an angle relative to the feeding device, and the feeding device is disposed in one of the feeding positions when the feed location swings up to the level position.

Other features which are considered as characteristic for the invention are set forth in the appended claims.

Although the invention is illustrated and described herein as embodied in a bobbin separating unit, it is nevertheless not intended to be limited to the details shown, since various modifications and structural changes may be made therein without departing from the spirit of the invention and within the scope and range of equivalents of the claims.

Figure 2:
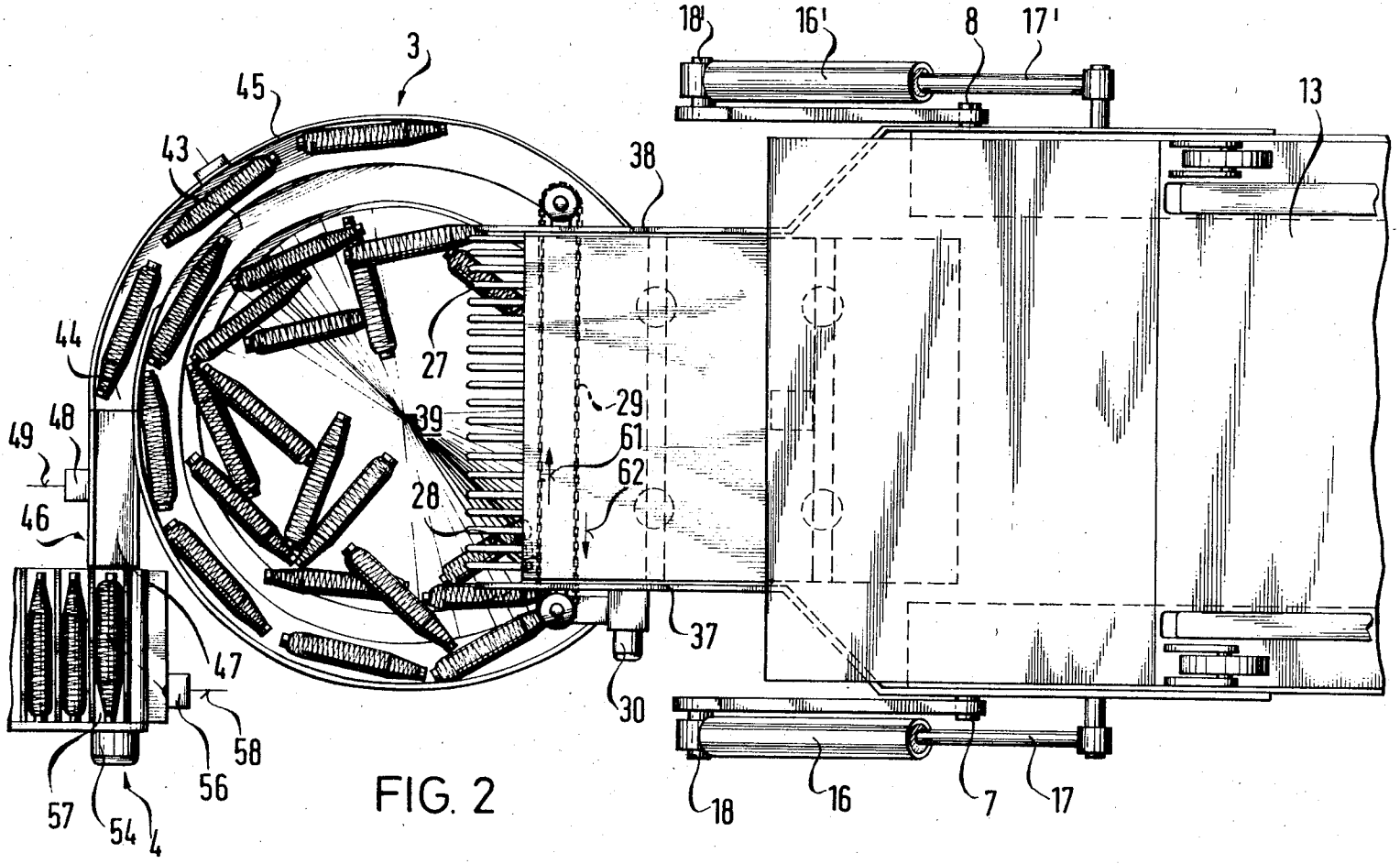

The construction and method of operation of the invention, however, together with additional objects and advantages thereof will be best understood from the following description of specific embodiments when read in connection with the accompanying drawings, in which:

FIG. 1 is a fragmentary, diagrammatic, side-elevational view of a bobbin separating unit; and FIG. 2 is a top-plan view of the bobbin separating unit shown in FIG. 1.

Referring now in detail to FIGS. 1 and 2 of the drawings as a whole, it is seen that in the illustrated embodiment of the invention the bobbin separating unit, which is designated as a whole with reference numeral 1, includes three bobbin separating devices 2, 3 and 4 interconnected and disposed in sequence. The first bobbin separating device 2 is provided with a feeding or charging device 5 which is controllable by the second bobbin separating device 3. The bobbin separating device 2 is provided with a frame 6 which is attached to the floor and carries the feeding device 5.

Two swivelling links 7, 8 determine a horizontal swivel axis 9, about which the feeding device 5 can be swivelled from a bobbin receiving position 5' shown in dot-dash lines, into its distributing, charging or feeding positions. The discharging positions are located above the upper level 10 of the second bobbin separating device 3.

The feeding device 5 is provided with an angle frame 11, which can be swung upward by means of a hydraulic actuating device 12. A carriage 13, filled with spinning bobbins or cops or other similar bobbins, can be wheeled onto the bottom part of the angle frame 11 and can be locked in position on the angle frame 11 by means of a pawl 14 in conjunction with a locking pin 15. Controlled hydraulic cylinders 16, 16' of the actuating device 12 cause the feeding device 5 to be swung upward so that the bobbins are emptied out of the carriage 13 in a controlled manner. This is done by the extension of piston rods 17, 17', which are articulatingly connected to the feeding device 5, while at the same time the hydraulic cylinders 16, 16' swivel about their axes 18, 18'. For this purpose, two hydraulic control valves 19 and 20 are provided, which can be controlled from a switch box 21 through leads 22, 23. The control valves are connected to a non-illustrated hydraulic system. The switch box 21 contains all the switches and interconnecting devices required for the functions which will be described below The pivotable feeding device 5 is provided with a feed table or plate 24 constructed in the form of a vibrating conveyor. As soon as the feed table 24 begins to vibrate, the spinning bobbins or cops 25 lying on it are moved on along in the feeding direction 26. The feed table 24 terminates in a comb 27 below which a yarn cutting device in the form of a travelling cutter 28 is disposed. As is shown in FIG. 2, the travelling cutter 28 is mounted on a circulating chain 29 which is driven by a motor 30. It can be seen from FIG. 1 that the travelling cutter 28 can cut off trailing yarn ends 31 without damaging the bobbins as they fall down In addition, the feed table 24 is provided with a vibration generator 32, which is controllable by a light barrier 33 of the second bobbin separating device 3. For this purpose, the light barrier 33 is connected, through a lead 34, to the switch box 21. Additional leads 35, 36, respectively, connect the switch box 21 to the motor 30 of the yarn cutting device 28 and to the vibration generator 32. In the illustrated embodiment the vibration generator 32 is an electromotively driven device for generating an imbalance. The feeding device 5 is bordered at its sides by protective walls 37, 38 which at the same time serve as guides for the carriage 13. The protective walls 37, 38 are interconnected by traverses 66, 67. The feed table 24 is supported on vibration absorbing means in the form of rubber buffers 64, 65 secured to the traverses or cross bars 66, 67.

The second yarn separating device 3 is constructed in the form of a bulk material rotary conveyor. This bulk material rotary conveyor has a conical bottom 39, which causes the spinning bobbins 40 fed onto it to slide or roll to its edge. The bobbin separating device 3 is set into vibration by a vibrator 41. This causes the bobbins lying at the egde of the bottom 39 to move up a ramp 43.

The ramp 43 extends from the bottom 39 to an upper rim 44 in the form of a helix. As can be seen from the drawings, the ramp 43 is also inclined toward the outside. The outside of the slide or ramp 43 is bordered by an ascending wall 45, which is also in the form of a helix. On the inside, bobbins lying across the ramp or piling up on top of one another can preferably fall back to the inside, into the bobbin supply.

At a transfer point, 46 from the second to the third bobbin separating device there is a chute 47 which is controlled by an optoelectrical switch 48. The optoelectrical switch 48 is connected by a lead 49 to the switch box 21. Each time a bobbin slides down the chute 47, the vibrator 41 which is connected to the switch box 21 by a lead 50, is switched off.

The third bobbin separating device 4 is formed of an endless conveyor belt 51 which has bars or webs 52 mounted thereon, and which passes around conveyor pulleys. One of the conveyor pulleys 53 is driven by a motor 54. The motor 54 is connected to the switch box 21 by a lead 55. An opto-electrial switch 56 checks the contents of a bobbin receiving compartment 57 of the bobbin separating device 4 which is directly in front of the chute 47. The opto-electrical switch 56 is connected to the switch box 21 by a lead 58 and causes the vibrator 41 to be switched on whenever the bobbin receiving compartment 57 is empty. After the compartment has been filled, the opto-electrical switch causes the conveyor belt 51 to be advanced by one division. The vibration generator 32 and the actuating device 12 are switched on by the light barrier 33 when the level of bobbins is below a predetermined filling level, and they are switched off when the level of bobbins is above the predetermined filling level, as is shown in FIG. 1. The breaks in the switching cycle occuring in the operation of the device avoid a succession of switch actuations which which is too rapid.

The device operates as follows:

At first, bobbins are neither available in the feeding devices nor in the bobbin separating devices. In order to prepare for the separation of the bobbins, a full carriage 13 is wheeled onto the bottom part of the angle frame 11 and is locked in position there The bobbin separating unit 1 starts operating when the switch 59 at the switch box 21 is switched on.

The conveyor belt 51 cannot begin operation since the opto-electrical switch 56 has not yet detected the presence of a bobbin in the bobbin receiving compartment 57. Therefore, the opto-electrical switch 56 switches on the vibrator 41 to cause the transfer of a bobbin from the second bobbin separating device 3. However, there are no bobbins there initially. This fact is also established by the light barrier 33, which consequently switches on the actuating device 12 and the vibration generator 32.

The actuating device 12 is switched on by opening the hydraulic control valve 19.

The actuating device 12 causes the angle frame 11 to be swung upward so that the carriage 13 is brought into a rocking position. The spinning bobbins therefore begin to slide out of the carriage 13 onto the feed table 24. Since the feed table 24 is constructed in the form of a flat conveyor, the bobbins are moved on along, individually or in small groups, in the direction shown by the arrow 26 and are fed into the second bobbin separating device 3.

The bobbins, which in this case means the spinning bobbins, move on, one after another, up the ramp 43, while at the same time more and more bobbins are fed into the bobbin separating device 3.

Finally, the light barrier establishes that the pile of bobbins fed to the device 3 has attained a maximum height, whereupon it switches off the actuating device 12 and the vibration generator 32. The transfer of bobbins from the first bobbin separating device to the second is thus stopped. Meanwhile, the travelling cutter 28 of the yarn cutting device travels in the direction shown by the arrows 61 and 62. On its way, the cutter cuts off any yarn ends that may be dragged along, the so-called trailing ends.

Meanwhile, the first few bobbins have arrived at the upper rim 44 of the second yarn separating device 3. When the first bobbin slides down over the chute 47, this is observed by the opto-electrical switch 48, which then switches on the vibrator 41.

Progressively, the feeding device 5, and with it the carriage 13, is brought into an extreme tipping or rocking position, as is shown in FIG. 1. The bobbins can therefore only be fed further onward by means of vibration. Finally, the feeding of bobbins ceases, which marks the timing for the feeding of a new carriage filled with bobbins, to the yarn bobbin separating device 2. To ensure a timely supply, the light barrier 33 causes an alarm signal to be given if a sufficient amount of bobbins has still not been fed into the bobbin separating device 3, after it has established the need for a fresh supply of bobbins and after a certain time delay of a predetermined length. This alarm signal attracts the attention of a supervisor, who can find out what the causes of the delay are and, if necessary, can have the carriage exchanged.

It is possible to block the actuating device 12 by means of a switch 63, during the time when the carriage is exchanged. When the actuating device 12 is unblocked after the carriage has been exchanged, the afore-described cycle of operation starts again.

As soon as the bobbin, which has been fed by way of the chute 47, lies in the bobbin receiving compartment 57 of the third bobbin separating device 4, this is observed by the optical equipment of the opto-electrical switch 56, which then causes the motor 54 to advance by one spacing and at the same time switches on the vibrator 41. In this way, a new bobbin receiving compartment is placed under the chute 47, and a fresh bobbin is fed to the chute.

The invention is not limited to the embodiment example described and illustrated above.

The foregoing is a description corresponding in substance to German Application No. P 33 34 873.1, filed Sept. 27, 1983, the International priority of which is being claimed for the instant application and which is hereby made part of this application. Any material discrepancies between the foregoing specification and the aforementioned corresponding German application are to be resolved in favor of the latter.

We claim:

1. Bobbin separating unit, comprising at least two first and second serially connected bobbin separating devices, said second bobbin separating device having a given upper level, said first bobbin separating device including a feeding device being controllable by said second bobbin separating device, said feeding device being movable from a bobbin receiving position to bobbin feeding positions disposed above said given upper level, and said first bobbin separating device including a feed location in the form of a vibratory conveyor disposed downstream of said feeding device, said feed location being swingable upward into a level position, said feeding device being pivotally mounted, said feed location being disposed at an angle relative to said feeding device, and said feeding device being disposed in one of said feeding positions when said feed location is in said level position.

2. Bobbin separating unit according to claim 1, wherein bobbins are transferred from said first to said second bobbin separating devices at a given transfer location, and including a yarn cutting device at said transfer location for cutting off trailing yarn ends.

3. Bobbin separating unit according to claim 2, wherein said yarn cutting device includes at least one travelling cutter.

4. Bobbin separating unit according to claim 2, including a comb disposed at a downstream end of said feed location, as seen in travel direction of the bobbins, said yarn cutting device being disposed below said comb in said feeding positions of said feeding device.

5. Bobbin separating unit according to claim 3, including a comb disposed at a downstream end of said feed location, as seen in travel direction of the bobbins, said yarn cutting device being disposed below said comb in said feeding positions of said feeding device.

6. Bobbin separating unit according to claim 1, including a vibration generator for vibrating said vibratory conveyor.

7. Bobbin separating unit according to claim 6, wherein said vibration generator is controllable by said second bobbin separating device.

8. Bobbin separating unit according to claim 1, including vibration absorbing devices connecting said feed location to said feeding device.

9. Bobbin separating unit according to claim 1, wherein said feeding device includes protective walls, and vibration absorbing devices connecting said protective walls to said feed location.

10. Bobbin separating unit according to claim 1, wherein said feeding device is inclined downward toward said feed location in said feeding positions of said feeding device.

11. Bobbin separating unit, comprising at least two first and second serially connected bobbin separating devices, said second bobbin separating device having a given upper level, said first bobbin separating device including a pivotable feeding device being controllable by said second bobbin separating device including a swingable feed location in the form of a vibratory conveyor disposed downstream of said feeding device, and including means for swinging said feed location upward into a level position as said feeding device pivots from said bobbin receiving position to one of said bobbin feeding positions.

* * * * *